US009963821B2

(12) United States Patent
Barak et al.

(10) Patent No.: US 9,963,821 B2
(45) Date of Patent: May 8, 2018

(54) MOISTURE-MANAGEMENT IN HYDROPHILIC FIBERS

(75) Inventors: Yehuda Barak, Kiryat Motzkin (IL); Monder Mois, Rama Village (IL)

(73) Assignee: DELTA GALIL INDUSTRIES, LTD., Tel-Aviv (IL)

( * ) Notice: Subject to any disclaimer, the term of this patent is extended or adjusted under 35 U.S.C. 154(b) by 1428 days.

(21) Appl. No.: 11/951,736

(22) Filed: Dec. 6, 2007

(65) Prior Publication Data

US 2008/0128044 A1 Jun. 5, 2008

(30) Foreign Application Priority Data

Nov. 15, 2004 (IL) ..... 165219

(51) Int. Cl.
*D06M 23/12* (2006.01)
*D06M 11/79* (2006.01)
(Continued)

(52) U.S. Cl.
CPC ..... *D06M 23/12* (2013.01); *D06M 11/79* (2013.01); *D06M 15/643* (2013.01);
(Continued)

(58) Field of Classification Search
CPC ..... D06M 11/79; D06M 23/12; D06M 23/08; D06M 15/643; D06M 11/00; D06M 101/06; D06M 101/02; D06M 11/40; D06M 101/00; D06M 16/00; D06M 7/00; D06M 220/40; D06M 11/32; D06M 11/38; D06M 11/64; D06M 11/70; D06M 11/55; D06M 11/75; D06M 11/11; D06M 11/155; D06M 11/62; D06M 15/65; D06M 13/256; D06M 15/37; D06M 13/00; D06M 13/224; D06M 15/53; D06B 7/08; D06B 3/00; D06B 3/26; D06B 1/12; D06B 1/00; D06C 21/00; D06P 1/0016; D06P 1/228; D06P 1/00;
(Continued)

(56) References Cited

U.S. PATENT DOCUMENTS 2,033,819 A * 3/1936 Downing et al. ..... 8/127
2,088,674 A * 8/1937 Whitehead ..... 8/137
(Continued)

FOREIGN PATENT DOCUMENTS

CN 1421566 6/2003
CN 1497097 5/2004
(Continued)

OTHER PUBLICATIONS

Merriam-Webster Online Dictionary. "Composition". http://www.merriam-webster.com/dictionary/composition. copyright 2014.*
(Continued)

*Primary Examiner* — Chinessa T Golden
(74) *Attorney, Agent, or Firm* — Paul D. Bianco; Katharine Davis; Fleit Gibbons Gutman Bongini & Bianco PL

(57) ABSTRACT

Provided is a fabric having improved moisture-management performance and being resilient to repeated washing, as well as a process for manufacturing the fabric. The process, employing consecutive steps of hydrophilization and hydrophobization, includes defatting cotton or cellulose fibers and their coating with silicone nanoparticles.

20 Claims, 7 Drawing Sheets

(51) Int. Cl.
*D06M 15/643* (2006.01)
*D06M 23/08* (2006.01)

(52) U.S. Cl.
CPC ..... *D06M 23/08* (2013.01); *Y10T 428/29* (2015.01); *Y10T 428/2933* (2015.01); *Y10T 428/2938* (2015.01); *Y10T 428/2962* (2015.01); *Y10T 442/218* (2015.04); *Y10T 442/2164* (2015.04); *Y10T 442/277* (2015.04); *Y10T 442/2762* (2015.04)

(58) Field of Classification Search
CPC . D06P 1/22; C08J 2383/04; C08J 3/03; D06L 3/00; D06L 1/12; D06L 1/00; D03D 25/00; D01H 13/30; D04B 21/00; D02J 7/00; D21C 5/00; D21C 3/02; D21C 3/00; D21C 3/26; D21C 1/06; D21C 1/00; D01C 1/00; D01F 2/28; D01F 2/00; D01F 11/02; C11D 3/16; C11D 3/00; C11D 9/04; C11D 9/26; C11D 7/02; A61K 2800/56; A61K 8/0241; A61K 8/375; A61K 8/60; A61K 8/645; A61K 8/678; A61K 2800/413; A61K 8/922; A61K 2800/28; A61K 8/342; A61K 8/37; B01J 2/02; B82Y 5/00; A61Q 19/06; A61Q 17/04; A61L 15/26; Y10T 428/2984; Y10T 428/2991; Y10T 428/2989; Y10T 428/2985; Y10T 428/2982; Y10T 428/2998
USPC ..... 252/8.62, 617; 427/180, 212; 428/141, 428/300.7, 375, 447, 364, 365, 378, 390, 428/391, 394, 397, 422, 907, 402.21, 402, 428/402.24, 403, 8.86; 442/79, 152, 153, 442/81, 286, 59, 125, 133, 96, 102, 132, 442/136, 97, 124, 123; 510/475, 476, 510/477, 357, 469, 356, 158, 481, 336, 510/345, 339, 513, 108; 524/1, 761, 759, 524/760, 773, 837; 8/127, 137, 130.1, 8/115.6, 115, 115.7, 122, 120, 116.1, 8/115.51, 196, 152, 111, 125, 151, 108.1, 8/107; 162/82, 89, 90, 97, 91, 99, 96, 40, 162/87, 80
See application file for complete search history.

(56) References Cited

U.S. PATENT DOCUMENTS

| | | | | |
|---|---|---|---|---|
| 3,511,699 | A * | 5/1970 | Johnson et al. | 442/81 |
| 5,925,469 | A | 7/1999 | Gee | |
| 6,432,504 | B1 | 8/2002 | Yeh | |
| 6,506,697 | B1 * | 1/2003 | Samel | 442/286 |
| 6,541,138 | B2 | 4/2003 | Bullock et al. | |
| 6,766,817 | B2 | 7/2004 | da Silva | |
| 6,918,404 | B2 | 7/2005 | Dias da Silva | |
| 7,066,586 | B2 | 6/2006 | da Silva | |
| 7,285,255 | B2 | 10/2007 | Kadlec et al. | |
| 2002/0065208 | A1 | 5/2002 | Aubay et al. | |
| 2003/0013369 | A1 * | 1/2003 | Soane et al. | 442/181 |
| 2003/0082379 | A1 | 5/2003 | Hrubesh et al. | |
| 2005/0059570 | A1 * | 3/2005 | Hsu et al. | 510/424 |
| 2005/0205830 | A1 | 9/2005 | Oles et al. | |
| 2006/0131550 | A1 | 6/2006 | Glassel et al. | |
| 2006/0173102 | A1 | 8/2006 | Jocham et al. | |
| 2007/0014970 | A1 | 1/2007 | Nun et al. | |
| 2008/0015531 | A1 | 1/2008 | Hird | |
| 2008/0019865 | A1 | 1/2008 | Kadlec | |

FOREIGN PATENT DOCUMENTS

| | | |
|---|---|---|
| DE | 102 31 757 | 1/2004 |
| DE | 102 61 805 | 7/2004 |
| DE | 103 08 379 | 9/2004 |
| EP | 0 924 240 | 6/1999 |
| EP | 1 371 718 | 12/2003 |
| EP | 1371718 A1 * | 12/2003 |
| WO | WO 02/084017 | 10/2002 |

OTHER PUBLICATIONS

Merriam-Webster Online Dictionary. "Mixture". http://www.merriam-webster.com/dictionary/mixture. copyright 2014.*
Merriam-Webster Online Dictionary, Detergent Definition, http://www.merriam-webster.com/dictionary/detergent, Sep. 2014.*
Morton, W.E. and J.W.S. Hearle. Physical properties of textile fibres. Manchester, U.K. 1993.
International Search Report PCT/IL2005/001153 (both PCT/IL2005/001153 and U.S. Appl. No. 11/957,736 claim priority to IL 165219).
International Preliminary Report on Patentability PCT/IL2005/001153 (both PCT/IL2005/001153 and U.S. Appl. No. 11/957,736 claim priority to IL 165219).
Written Opinion for PCT/IL2005/001153 (both PCT/IL2005/001153 and U.S. Appl. No. 11/957,736 claim priority to IL 165219).
Database WPI, Section Ch, Week 200357 Derwent Publications Ltd., London, GB; AN 2003-599226, XP002369331 & CN 1 421 566 A (Zhang G) Jun. 4, 2003.
Database WPI, Section Ch, Week 200455, Derwent Publicationa Ltd., London, GB; AN 2004-101009, XP002369332 & CN 1 497 097 (Rohm & Haas Co) May 19, 2004.
William A. Rearick, Vikki B. Martin, and Michele L. Wallace, Moisture Management: Myths, Magic and Misconceptions, Cotton Incorporated, Cary, NC.
Journal of Textile and Apparel, Technology and Management, vol. 2, Issue 3, Summer 2002, Cotton Incorporated, Cary, North Carolina.

* cited by examiner

Table I-FABRIC SAMPLES BEFORE TREATMENT
VERTICAL WICKING
NIKE PF3-2001

| | WICKING | | | | | | WICKING | | | | | | | | |
|---|---|---|---|---|---|---|---|---|---|---|---|---|---|---|---|
| | BEFORE WASH | | | AFTER 1 WASH | | | AFTER 5 WASHES | | | AFTER 20 WASHES | | | AFTER 30 WASHES | | |
| | TIME | L | W | TIME | L | W | TIME | L | W | TIME | L | W | TIME | L | W |
| | min. | cm | cm | min. | cm | cm | min. | cm | cm | min. | cm | cm | min. | cm | cm |
| 5276 | 3 | 8 | 7 | 3 | 9 | 605 | 3 | 10.5 | 7.5 | 3 | 10 | 7 | 3 | 10 | 7 |
| 100%COTTON 40/1 | 22 | 15 | | 17 | 15 | | 11 | 15 | | 11 | 15 | | 11.5 | 15 | |
| RIB | 30 | | 12.5 | 30 | | 13 | 30 | | 13.5 | 30 | | 14 | 30 | | 14 |
| 7017 | 3 | 8 | 8 | 3 | 7.5 | 7.5 | 3 | 8.5 | 9 | 3 | 7.5 | 8.5 | 3 | 7.5 | 8.5 |
| %PIMA 80/1 /9%LYCRA | 26 | 15 | | 22 | 15 | | 21 | 15 | 15 | 18 | 15 | 15 | 18 | 15 | 15 |
| SINGLE | 27 | | 15 | 23 | | 15 | | | | | | | | | |
| 7625 | 3 | 7.5 | 7.5 | 3 | 6.5 | 7.5 | 3 | 8 | 8.5 | 3 | 8 | 8 | 3 | 8 | 8.5 |
| 92%COTTON 30/1 / 8%LCRA | 26 | | 15 | 22 | | 15 | 20 | 15 | 15 | 19 | 15 | 15 | 19 | 15 | |
| SINGLE | 27 | 15 | | 25 | 15 | | | | | | | | 20 | | 15 |
| 6719 | 3 | 8 | 8 | 3 | 8 | 8 | 3 | 8.5 | 8.5 | 3 | 9 | 8.5 | 3 | 9 | 8.5 |
| 95% COTTON 40/1 / 8%LYCRA | 22 | 15 | | 22 | 15 | | 19 | 15 | 15 | 17 | 15 | 15 | 18 | 15 | |
| SINGLE | 30 | | 15 | 26 | | 15 | | | | | | | 19 | | 15 |
| 7481 | 3 | 7 | 8 | 3 | 8 | 8 | 3 | 8.5 | 8.5 | 3 | 8 | 9 | 3 | 8 | 8.5 |
| 92%PIMA 50/1 / 8%LYCRA | 23 | | 15 | 22 | 15 | 15 | 19 | 15 | | 16 | 15 | | 16 | 15 | |
| SINGLE | 24 | 15 | | | | | 20 | | 15 | 18 | | 15 | 18 | | 15 |

WICKING
STANDARD:

MINIMUM 15CM. IN
MAXIMUM 30 MIN

Fig. 2

Table II-FABRIC SAMPLES AFTER TREATMENT

VERTICAL WICKING NIKE PF3-2001

| | WICKING | | | | | | WICKING | | | | | | | | |
|---|---|---|---|---|---|---|---|---|---|---|---|---|---|---|---|
| | BEFORE WASH | | | AFTER 1 WASH | | | AFTER 5 WASHES | | | AFTER 20 WASHES | | | AFTER 30 WASHES | | |
| | TIME | L | W | TIME | L | W | TIME | L | W | TIME | L | W | TIME | L | W |
| | min. | cm | cm | min. | cm | cm | min. | cm | cm | min. | cm | cm | min. | cm | cm |
| 5276 | 3 | 8.5 | 6.5 | 3 | 8.5 | 7 | 3 | 9.5 | 7 | 3 | 10 | 7 | 3 | 10 | 7.5 |
| 100%COTTON 40/1 | 24 | 15 | | 18 | 15 | | 14 | 15 | | 12 | 15 | | 10 | 15 | |
| RIB | 30 | | 12.5 | 30 | | 13 | 30 | | 13.5 | 30 | | 14 | 30 | | 15 |
| 7017 | 3 | 8 | 8 | 3 | 7.5 | 8 | 3 | 7.5 | 8 | 3 | 8.5 | 8.5 | 3 | 8 | 8.5 |
| 91%PIMA 80/1 /9%LYCRA | 22 | 15 | | 24 | | 15 | 22 | 15 | 15 | 18 | 15 | 15 | 17 | 15 | 15 |
| SINGLE | 26 | | 15 | 25 | 15 | | | | | | | | | | |
| 7625 | 3 | 7.5 | 8 | 3 | 7 | 7.5 | 3 | 8 | 8 | 3 | 7.5 | 8 | 3 | 8 | 8 |
| 92%COTTON 30/1 / 8%LYCRA | 23 | | 15 | 21 | | 15 | 19 | | 15 | 20 | | 15 | 18 | | 15 |
| SINGLE | 25 | 15 | | 23 | 15 | | 22 | 15 | | 21 | 15 | | 19 | 15 | |
| 6719 | 3 | 7.5 | 7.5 | 3 | 8.5 | 8 | 3 | 9 | 8.5 | 3 | 9 | 8.5 | 3 | 9 | 8.5 |
| 95% COTTON 40/1 / 8%LYCRA | 26 | 15 | | 21 | 15 | | 19 | 15 | | 16 | 15 | | 15 | 15 | |
| SINGLE | 30 | | 12 | 29 | | 15 | 25 | | 15 | 18 | | 15 | 17 | | 15 |
| 7481 | 3 | 8 | 7.5 | 3 | 7.5 | 7.5 | 3 | 8 | 7.5 | 3 | 8 | 8.5 | 3 | 8 | 8.5 |
| 92%PIMA 50/1 / 8%LYCRA | 27 | 15 | 15 | 23 | 15 | | 20 | 15 | 15 | 17 | | 15 | 18 | 15 | 15 |
| SINGLE | 29 | | 15 | 25 | | 15 | | | | 18 | 15 | | | | |

WICKING STANDARD:

MINIMUM 15CM. IN MAXIMUM 30 MIN

Fig. 3

WICKING & EVAPORATION
DROP TEST

TABLE III -FABRIC SAMPLES BEFRE TREATMENT

M&S TEST P 136 A

| SAMPLE | BEFORE WASH | | | AFTER 1 WASH | | | AFTER 5 WASHES | | | AFTER 20 WASHES | | | AFTER 30 WASHES | | |
|---|---|---|---|---|---|---|---|---|---|---|---|---|---|---|---|
| | WICKING | | EVAPOR. | WICKING | | EVAPOR. | WICKING | | EVAPOR. | WICKING | | EVAPOR. | WICKING | | EVAPOR. |
| | AREA ($mm^2$) | | % | AREA ($mm^2$) | | % | AREA ($mm^2$) | | % | AREA ($mm^2$) | | % | AREA ($mm^2$) | | % |
| | 1 min. | 10 min. | 10 min. | 1 min. | 10 min. | 10 min. | 1 min. | 10 min. | 10 min. | 1 min. | 10 min. | 10 min. | 1 min. | 10 min. | 10 min. |
| 5276 | 844 | 981 | 12.5 | 777 | 922 | 20 | 628 | 959 | 22.2 | 740 | 939 | 20 | 829 | 1060 | 11.11 |
| 7017 | 1014 | 1255 | 10 | 1036 | 1094 | 20 | 1014 | 1193 | 20 | 895 | 1154 | 20 | 1005 | 1154 | 11.11 |
| 7625 | 592 | 683 | 10 | 550 | 769 | 11.1 | 636 | 777 | 20 | 637 | 754 | 20 | 653 | 824 | 11.1 |
| 6719 | 886 | 1080 | 22.2 | 699 | 955 | 12.5 | 776 | 973 | 22.2 | 857 | 989 | 20 | 769 | 960 | 11.11 |
| 7481 | 801 | 879 | 11.1 | 632 | 929 | 20 | 824 | 964 | 18.2 | 813 | 949 | 22.2 | 622 | 925 | 22.2 |

Fig. 4

TABLE IV- WICKING & EVAPORATION DROP TEST

FABRIC SAMPLES AFTER TREATMENT

M&S TEST p-136 A

| SAMPLE | BEFORE WASH | | | AFTER 1 WASH | | | AFTER 5 WASHES | | | AFTER 20 WASHES | | | AFTER 30 WASHES | | |
|---|---|---|---|---|---|---|---|---|---|---|---|---|---|---|---|
| | WICKING | | EVAPOR. | WICKING | | EVAPOR. | WICKING | | EVAPOR. | WICKING | | EVAPOR. | WICKING | | EVAPOR. |
| | AREA ($mm^2$) | | % | AREA ($mm^2$) | | % | AREA ($mm^2$) | | % | AREA ($mm^2$) | | % | AREA ($mm^2$) | | % |
| | 1 min. | 10 min. | 10 min. | 1 min. | 10 min. | 10 min. | 1 min. | 10 min. | 10 min. | 1 min. | 10 min. | 10 min. | 1 min. | 10 min. | 10 min. |
| 5276 | 1017 | 1248 | 20 | 722 | 903 | 22.2 | 1060 | 1295 | 25 | 776 | 1017 | 22.2 | 758 | 980 | 30 |
| 7017 | 883 | 1181 | 22.2 | 852 | 984 | 22.2 | 955 | 1126 | 22.2 | 1071 | 1133 | 22.2 | 949 | 1121 | 25 |
| 7625 | 751 | 854 | 20 | 593 | 777 | 22.2 | 628 | 751 | 20 | 673 | 774 | 30 | 653 | 728 | 25 |
| 6719 | 843 | 1022 | 20 | 741 | 1005 | 18.2 | 813 | 955 | 22.2 | 791 | 949 | 20 | 769 | 955 | 22.2 |
| 7481 | 746 | 1005 | 22.2 | 871 | 955 | 20 | 842 | 954 | 22.2 | 895 | 1041 | 20 | 871 | 942 | 25 |

STANDARD M&S

EVAPORATION: 20% -40%

WICKING: 600 -1000 $mm^2$

Fig. 5

ABSORBENCY

AATCC 79

Table V - FABRIC SAMPLES BEFORE TREATMENT

ABSORBENCY

| FABRIC | BEFORE WASH | | AFTER WASH | | AFTER 5 WASHES | | AFTER 20 WASHES | | AFTER 30 WASHES | |
|---|---|---|---|---|---|---|---|---|---|---|
| | Right sec | Link sec | Right sec | Left sec | Right sec | Link sec | Right sec | Link sec | Right sec | Left sec |
| 5276 100%COTTON 40/1 RIB | 1 | 1 | 1 | 1 | 1 | 1 | 1 | 1 | 1 | 1 |
| 7017 91%PIMA 80/1 / 9%LYCRA SINGLE | 1 | 1 | 1 | 1 | 1 | 1 | 1 | 1 | 1 | 1 |
| 7625 92%COTTON 30/1/ 8%LYCRA SINGLE | 2 | 2 | 2 | 2 | 1 | 1 | 1 | 1 | 1 | 1 |
| 6719 95%COTTON 40/1/8%LYCRA SINGLE | 1 | 1 | 1 | 1 | 1 | 1 | 1 | 1 | 1 | 1 |
| 7481 92%PIMA 50/1 /8%LYCRA SINGLE | 1 | 1 | 1 | 1 | 1 | 1 | 1 | 1 | 1 | 1 |

ABSORBENCY

STANDARD:

MAXIMUM 30 sec

Fig. 6

ABSORBENCY
AATCC 79
Table VI - FABRIC SAMPLES AFTER TREATMENT
ABSORBENCY

| FABRIC | BEFORE WASH | | AFTER WASH | | AFTER 5 WASHES | | AFTER 20 WASHES | | AFTER 30 WASHES | |
|---|---|---|---|---|---|---|---|---|---|---|
| | Right sec | Link sec | Right sec | Left sec | Right sec | Link sec | Right sec | Link sec | Right sec | Left sec |
| 5276 100%COTTON 40/1 RIB | 1 | 1 | 1 | 1 | 1 | 1 | 1 | 1 | 1 | 1 |
| 7017 91%PIMA 80/1 / 9%LYCRA SINGLE | 1 | 1 | 1 | 1 | 1 | 1 | 1 | 1 | 1 | 1 |
| 7625 92%COTTON 30/1/ 8%LYCRA SINGLE | 2 | 2 | 2 | 2 | 1 | 1 | 1 | 1 | 1 | 1 |
| 6719 95%COTTON 40/1/8%LYCRA SINGLE | 1 | 1 | 1 | 1 | 1 | 1 | 1 | 1 | 1 | 1 |
| 7481 92%PIMA 50/1 /8%LYCRA SINGLE | 1 | 1 | 1 | 1 | 1 | 1 | 1 | 1 | 1 | 1 |

ABSORBENCY

STANDARD:

MAXIMUM 30sec

Fig. 7

MOISTURE-MANAGEMENT IN HYDROPHILIC FIBERS

CROSS REFERENCE TO RELATED APPLICATION

This application is a continuation in part of U.S. patent application Ser. No. 11/274,052, filed Nov. 15, 2005, which claims priority under 35U.S.C. § 119 to Israeli Patent Application No. 165219, filed Nov. 15, 2004. The entire contents of each of the above-identified applications is incorporated herein by reference.

FIELD OF THE INVENTION

The present invention relates to a process for rendering hydrophilic fibers less absorbing of moisture properties, and improved moisture-management in yarns and fabrics thereof. More specifically, the present invention relates to cotton or cellulose fibers within yarns or fabric constructions, where their moisture transmission throughout is improved.

BACKGROUND OF THE INVENTION

Moisture-management rapidly accumulates increased interest in high-tech textile industry as an important factor in recreational as well as customary garments and apparels. The need for fast drying type fabrics, especially for athletic purposes, has so far been satisfied with the use of synthetic hydrophobic materials that do not absorb moisture. However, the ability to control perspiration absorption, transport, and evaporation off skin tissue through apparels, made of natural hydrophilic materials, especially ones as cotton, to the atmosphere enables their use in areas traditionally governed by the synthetic fabrics.

Moisture-management is defined in the Journal of Textile and Apparel, Technology and Management, Vol. 2, Issue 3, Summer 2002, as "the controlled movement of water vapor and liquid water (perspiration) from the surface of the skin to the atmosphere through the fabric". Although mostly referred to perspiration, this term may be more broadly related to release of liquid, secreted from different body organs through skin tissue, and its subsequent transport and removal.

Cotton fabrics are well known to impart a more pleasant feeling upon contact with skin tissue, and are mostly preferred due to either their natural origin or other superior qualities over synthetic fibers. However, being essentially of hydrophilic nature, they are known to absorb liquids secreted through skin tissue, and release them only too slowly into the atmosphere, especially when a wearer is being engaged with excessive physical activity. These features produce a heavy apparel when wet, which imparts an uncomfortable wet and sticky sensation to the wearer. Additional effects are the limiting of one's motion, and induction of a cold feeling during recess.

Several approaches are known to date in processing hydrophilic fabrics, e.g., cotton, into fast drying type. Drying rate of cotton fabrics with reduced thickness turned to be equal to that of polyester fabrics. Other solutions employed the use of blends of cotton and synthetic fibers, e.g., cotton/polyester, cotton/nylon, or cotton/polypropylene, hydrophobic backing layers as silicone, or waxes on the fabric side, which is close to the skin, or scouring, bleaching, and finishing of 100% cotton fabrics (for the last approach see, Moisture Management: Myths, Magic and Misconceptions, William A Rearick, Vikki B. Martin, and Michele L. Wallace, Cotton Incorporated, Cary, N.C.).

Moisture-management in hydrophilic fabrics is translated into a wicking process of the liquid absorbed, in which a spontaneous transport of the liquid is driven through pores and spaces in the fabric by capillary forces. The surface tension of the liquid causes a pressure difference across the curved liquid-air (vapor) giving a liquid movement. Wicking is also affected by the morphology of the fiber surface, and may be affected by the shape of the fibers. The rate of wicking is affected by the size and geometry of the capillary spaces between fibers. Therefore, wicking can be improved by changing the fiber surface by absorption of surfactant.

Although the aforementioned detailed reference relates mostly to cotton, the inventive concept of the present invention applies equally to other raw materials, from which man-made fibers, yarns, and various types of fabrics, garments, and apparels may be produced. Cotton and cellulose, the latter also having hydrophilic tendency and good water absorption similar to that of cotton, are good examples of raw materials from which moisture-management improved man-made fibers may be produced. Such man-made fibers are, therefore, good potential candidates for the fabrication of improved moisture-management textile products according to the teaching of the present invention, while sustaining their other virtues essentially unaffected. In its broader scope, the present invention, therefore, relates also to man-made yarns and fabrics and end-uses thereof, which are made of essentially hydrophilic materials, and which are of improved moisture-management qualities according to the teaching of the present invention.

It is therefore an object of the present invention to provide a process for the manufacture of yarns and fabrics with improved moisture-management performance.

Still another object of the present invention is to provide a process for the manufacture of fabrics possessing improved performance of moisture-absorption, moisture-transportation, and moisture-evaporation.

Still another object of the present invention is to provide a process for the manufacture of fabrics with improved wicking effect.

Still another object of the present invention is to provide a process for the manufacture of modified encapsulated fibers within a fabric.

Still another object of the present invention is to provide a nano technology process for the manufacture of silicone-encapsulated fibers in a fabric, where the silicone encapsulation is of particulate form of nano-scale size, and therefore the encapsulation being applied include nano chemistry process.

In still another object of the present invention the fabrics and fibers thus manufactured are of surface area and morphology that while being silicon-encapsulated improved, their moisture-management and wicking are improved.

Still another object of the present invention is to provide silicon-encapsulated fibers in a fabric, where the encapsulation includes a nano technology chemistry.

Still another object of the present invention is to provide fabrics comprising silicone-encapsulated fibers.

In still another object of the present invention the fabrics comprising silicone-encapsulated fibers for moisture-management improvement comprise woven, non-woven, textured, or knitted forms.

Still another object of the present invention is to provide garment and textile articles comprising silicone-encapsulated fibers imparting more comfortable sensation upon use, and improved moisture-management, wicking, transportation, and evaporation.

In still another aspect of the present invention the fibers, yarns, fabrics, and end-uses textiles thereof, are essentially made of hydrophilic materials, which are good water absorbents. Particularly, the fibers, yarns, and fabrics of the present invention are either cotton or man-made cotton or cellulose fibers, yarns and fabrics, respectively.

In one preferred embodiment, the present invention provides a process for the manufacture of silicon-encapsulated cotton yarns and fabrics with improved moisture-management performance, the moisture-management being expressed in moisture-absorption, moisture-transportation, i.e., wicking, and moisture-evaporation.

In a second preferred embodiment, the present invention provides a process for the manufacture of silicone-encapsulated man-made cotton or cellulose yarns and fabrics with improved moisture-management performance, the moisture-management being expressed in moisture-absorption, moisture-transportation, i.e., wicking, and moisture-evaporation.

SUMMARY OF THE INVENTION

The invention provides a process of manufacturing a cotton- or cellulose-containing fabric, employing consecutive steps of hydrophilization and hydrophobization, comprising i) treating a cotton or cellulose fiber with a defatting composition, whereby providing a super hydrophilic filament; ii) treating said super hydrophilic filament with a composition comprising nanoparticles of silicone, whereby obtaining hydrophobized yarn; and iii) tightly weaving or knitting said hydrophobized yarn into said fabric; thereby obtaining a fabric with improved moisture-management performance and being resilient to repeated washing. Said fiber is preferably a cotton fiber or a processed-cellulose fiber. In an important aspect of the invention, said fabric comprises said hydrophobized yarn combined with a synthetic fiber, preferably polyamide or polyester. Said hydrophilization step comprises immersing said fiber in a mixture of a strong base and a detergent, said hydrophobization step comprises immersing said filament in a suspension comprising silicone nanoparticles. Said two consecutive steps lead to the encapsulation of said super hydrophilic filament with a surface of silicone nanoparticles, supposedly water-repellant, thereby imparting the improved moisture-management performance to said fabric. Said filament has preferably a non-circular shape, preferably a bean shape. Said improved moisture-management performance is probably achieved by wicking moisture through open channel formed between said yarns in the fabric. In a preferred embodiment of the invention, said synthetic fiber is LYCRA. The process of the invention may further comprise treating said fabric with additives selected from the group consisting of washing additives, bleaching additives, dying finishing additives, colorants, and finishing additives.

The invention relates to a cotton- or cellulose-containing fabric with improved moisture-management performance and being resilient to repeated washing, comprising cotton or cellulose fibers defatted with strong base and detergent, and coated with silicone nanoparticles. Said fibers are preferably cotton fibers or processed-cellulose fibers. Said fabric, in a preferred embodiment of the invention, comprises a synthetic fiber combined with said defatted and coated cotton or cellulose fiber. Said synthetic fiber is, for example, LYCRA. Said defatted fibers coated with particulate silicone of nano-scale size seem to form open channels through which the moisture is wicked from the wearer's skin outside. Provided by the invention is also a textile article comprising the fabric as described above. Said textile article may include apparel, garment, and other clothing, all having improved moisture-management performance.

The present invention provides the benefits of both a fabric comprising modified textile fibers, imparting a pleasant sensation upon contact with skin tissue, and improved moisture-management performance, essentially alleviating uncomfortable perspiration and heat off the skin.

Moisture- or water-management in hydrophilic yarns and fabrics, especially in hydrophilic cotton or man-made cotton or cellulose yarns and fabrics, is achieved through wicking of excessive moisture through the fibers themselves and through pores in between them. Wicking in hydrophobic silicone-encapsulated fibers is carried-out through capillaries formed between individually encapsulated fibers. That is, each fiber is encapsulated with a moisture-repellant material, the fibers are tightly bound together, and wicking does not take place through the fibers themselves. Especially, treatment of either cotton or man-made fibers with silicone, which is a hydrophobic material, and silicone encapsulation is therefore of double purpose; preventing penetration of moisture inside the fibers themselves, for example during body perspiration, or in any other form of secretion of water, aqueous solutions, suspensions, dispersions and the like at the same time ensuring moisture-transportation and evaporation through capillary wicking in between the fibers.

Furthermore, a commonly known drawback in most contemporary improved fabrics in this field is the gradual, continuous deterioration in moisture-management during use, and especially after repeated washings. Contrary to that, the process of the present invention, and the fibers, and fabrics thereof, offer at least sustaining moisture-management performance level during use, and in most cases even its improvement, especially after repeated washings. The latter phenomenon results due to washing-off of extra silicone particles inhabiting the inter-fiber capillaries, thus opening them, and allowing better breath ability, and wicking of moisture absorbed. This fact sets an important advantage of the process of the present invention over other processes for the manufacture of fibers and fabrics thereof known in this field, demonstrating a more resilient, life-extended fiber, fabrics, textile, and garment articles comprising it.

In accordance with the nano technology process of the present invention, encapsulation treatment of the fibers is carried-out with water-repellant nano chemistry silicone. Preferably, this encapsulation is conducted essentially by bringing each individual fiber in contact with silicone nanoparticles, also termed nano-silicone. Preferably, this contact takes place by immersing the fibers in particulate silicone suspension, thus ensuring maximal silicone coverage of each fiber surface area. Since silicone is a hydrophobic material, moisture penetration into the cotton fibers is thus prevented, while capillary wicking process takes over in moisture transportation off the skin, the concurrent evaporation, and as a result a cool and comfortable feeling.

A preferable feature of the fibers, aiding in the wicking process, is their surface morphology. As is demonstrated in FIGS. 1A and 1B, the cotton fibers employed, may be of an alternating concave/convex and flattened shape. The fibers morphology may be alternatively described as that of bean shape, where the fibers take a slightly flat and twisted shape. Such morphology forms multiple conduits between the fibers, which are designated in FIG. 1A as I, II, III, and IV, in which moisture-air surface tension increases, vertical capillarity of moisture is enhanced, and as a result wicking process is accelerated through these conduits.

Fabrics, textiles, apparels, and garments of the present invention may further comprise other types of fibers in combination with the modified cotton or man-made cotton or cellulose fibers. In one embodiment of the present invention the fabrics comprise cotton fibers, which are incorporated with Lycra in a volume ratio of 1:10.

Thus, the instant invention is based on combined treatments applied to the fabric before the dyeing and finishing together with the usage of nano-technology. The main purpose of the treatment given to the fabric prior to the dyeing and finishing process, is to allow the moisture to spread in very high rate on large fabric surface area, facilitating it to evaporate. The process is based on a strongly defatting treatment, employing simultaneously strong alkali with detergents, leading to clearing the fiber, probably comprising removing both the surface of the fiber, as well as its inner volume, of oily and waxy materials, and of other impurities in the fabric. The originally inherently hydrophilic material, becoming still less hydrophobic, is in fact converted to a super-hydrophilic filament. Although the mechanism of achieving the observed superior moisture management is not entirely clear, it seems that apparently paradoxical consecutive inclusion of hydrophilizing and hydrophobizing steps improves the wicking properties of the fabric. Additionally, said two consecutive steps result in a fabric with improved resilience to repeated washing, seemingly resulting from very firm attachment of the nanoparticles to the superhydrophilic filaments.

All the above and the characteristics and advantages of the invention will be further explained through the following illustrative and non-limitative examples.

BRIEF DESCRIPTION OF THE DRAWINGS

The above and other characteristics and advantages of the invention will be more readily apparent through the following examples, and with reference to the appended figures, wherein:

FIG. 2 is Table I;

FIG. 3 is Table II;

FIG. 4 is Table III;

FIG. 5 is Table IV;

FIG. 6 is Table V; and

FIG. 7 is Table VI.

EXAMPLES AND TEST RESULTS

Figure 1A:
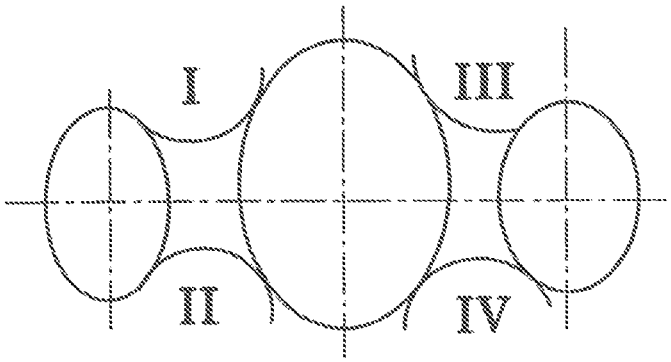
FIG. 1A is a top view of the cotton fibers empolyed in an alternating concave/convex and flattened shape.
Figure 1B:
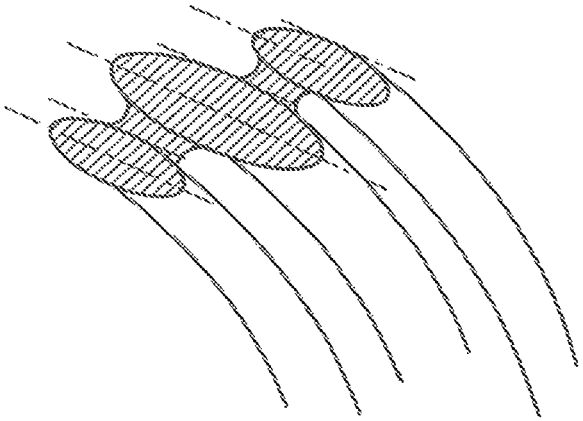
FIG. 1B is a perspective view of the cottong fibers employed in an alternating concave/convex and flattened shape.

Wicking tests of untreated and treated cotton fabrics have been conducted under two standard test methods, i.e., Drop Test, and Vertical Wicking, the latter being according to both M&S (Marks and Spencer) and Nike standard test.

The results, presented in the following Tables, refer either to time-dependent advance of moisture in the capillary channels of a cotton fabric, in accordance with the Vertical Wicking test method, or to time-dependent area coverage advance of the moisture in the fabric, measured close to starting and advanced time points, in accordance with the test method of Drop Test. The Drop Test also includes percentage measurements of moisture evaporation at a predetermined time-point.

In both tests, the fabrics were further tested for sustaining wicking performance level after repeated washes. It should be mentioned in this regard, that although it is common practice to test fabrics up to between 10 and 20 wash rounds, the tests of the fabrics of the present invention continued further to up to 30 wash rounds. Another point is that each wash round included 30 cycles at 40° C., Tumble Dry, that is, the fabrics were washed and dried repeatedly.

Absorbency test were conducted in accordance with Nike absorbency test method and standard, and were aimed at measuring the susceptibility of the fabric to take in and retain a liquid (usually water) within the pores and construction of the fabric. Absorbency rate of a drop was measured in five different areas, and in both front and back surfaces of the fabric. The minimal time period required for determining absorbency in fabrics was set to 30 seconds.

Analysis of the results is provided in accordance with the following Tables I-VI.

Fabrics made essentially of cotton fibers or cotton/Lycra combinations with known relations, were tested for moisture-management before and after treatment. Table I herein summarizes time-dependent results obtained for pre-treated fabrics under Nike standard test. According to this standard, the advance of moisture through the fabric essentially measures wicking; this is done by the vertical test at the fabric length 'L' and the fabric width 'W'. As is noted in the caption below, a time-dependent distance of 15 cm in maximal 30 minutes time interval is a minimal requirement for quality assurance.

The results obtained were further compared to those of treated fabrics comprising silicone-encapsulated cotton fibers or silicone-encapsulated cotton/Lycra fiber combinations.

It is clear from Table I (FIG. 2), that all pre-treated fabrics pass the wicking test, and are not affected by repeated washing. Successful wicking, as the results in Table II (FIG. 3) demonstrate, is observed also in the treated fabrics, in most cases accompanied by an exceptional improvement with increasing wash rounds, contrary to ordinary decrease in performance.

Wicking test was also conducted under Drop Test standard, and moisture evaporation test as well. Same fabrics that were tested for wicking as shown in Tables I and II, were tested here, only according to this standard the area coverage of moisture in the fabrics was measured at close to starting and end time points. Evaporation was measured at a time point of 10 minutes after moisture-absorbance, and relative to the wet fabric weight. The minimum requirements for successfully passing this test were between 600 to 1000 $mm^2$ area coverage, and between 20% and 40% relative evaporation. The results are summarized in Tables III and IV below (FIG. 4 and FIG. 5).

Table III demonstrates that all pre-treated fabrics pass successfully the wicking test, while essentially and mostly do not comply with the minimum sufficient level of evaporation. In contrast, the same type of fabrics comprising silicone-encapsulated cotton fibers or combinations of silicone-encapsulated cotton fibers/Lycra pass successfully both wicking and evaporation tests. The exceptional successful and even improved results of both wicking and evaporation tests are repeated under this standard as well. It is therefore straightforwardly concluded that this phenomenon is inherent to those fabrics that comprise silicone-encapsulated cotton fibers.

It should also be noted that the combination of both good wicking and good evaporation performances results in the desired goal of the present invention, as well as the one in the field of fast-drying type hi-tech fabrics. That is, fabrics that comprise silicone-encapsulated cotton fibers in accordance with the teaching of the present invention, provide both moisture-absorbance and fast moisture-transport and moisture-release.

Absorbency tests were conducted to assure the minimum requirement for standard moisture-absorption rate, substantially being set to minimum time interval of 30 seconds. Tables V and VI (FIG. 6 and FIG. 7) herein, present the pre-treated and treated fabrics, respectively. As can be clearly seen, silicone-encapsulation does not negatively affect the susceptibility to moisture of the fabrics.

In summary, according to the results presented hereinabove, the novel fabrics of the present invention essentially and substantially demonstrate excellent moisture-management performance, which is also durable with time and repeated use. The fabrics of the present invention are, therefore, excellent materials for various garment and textile applications, and for various daily, regular, recreational, or many other applications.

While examples of the invention have been described for purposes of illustration, it will be apparent that persons skilled in the art can carry out many modifications, variations and adaptations, without exceeding the scope of the claims.

The invention claimed is:

1. A process for manufacturing a cotton- or cellulose-containing fabric which exhibits improved moisture management compared to fabric not manufactured by the process, the moisture management further improving with repeated washing of the fabric, the process consisting of three consecutive steps:

i) a hydrophilization step including treating cotton or cellulose fibers with a strongly defatting composition containing a mixture of a strong alkali and a detergent, the composition added to the fibers to clear the fibers of oily and waxy materials and other impurities, thereby decreasing hydrophobicity of the fibers and converting the fibers to super-hydrophilic filaments;

ii) a hydrophobization step including treating the super-hydrophilic filaments resulting from carrying out step i) with a composition containing nanoparticles of silicone to encapsulate the super-hydrophilic filaments in silicone, wherein the treating includes immersing the super-hydrophilic filaments in a suspension comprising silicone nanoparticles bringing each individual super-hydrophilic filament of the super-hydrophilic filaments in contact with the silicone nanoparticles, thereby obtaining hydrophobized yarn; and iii) a production step including tightly weaving or knitting the hydrophobized yarn obtained from carrying out step ii) into a fabric, the tight weaving or knitting forming inter-fiber capillaries in the fabric; wherein the improved moisture management is essentially achieved by wicking moisture through the inter-fiber capillaries, which further open into channels as extra silicone particles inhabiting the inter-fiber capillaries wash-off with repeated washing of the fabric.

2. The process according to claim 1, wherein the fibers treated in step i) are cotton fibers.

3. The process according to claim 1, wherein the fibers treated in step i) are processed-cellulose fibers.

4. The process according to claim 1, further comprising weaving or knitting a synthetic fiber with the hydrophobized yarn in step iii) to produce a fabric combining the hydrophobized yarn with synthetic fibers.

5. The process according to claim 4, wherein the synthetic fiber woven or knitted with the hydrophobized yarn comprises polyamide or polyester.

6. The process according to claim 1, wherein the hydrophilization step i) includes immersing the fibers in the composition including strong alkali and detergent.

7. The process according to claim 1, wherein carrying out the steps i) and ii) results in encapsulating the super-hydrophilic filaments with a water-repellant surface of silicone nanoparticles, thereby obtaining hydrophobized yarn.

8. The process according to claim 1, wherein a cross section of each of the super-hydrophilic filaments is non-circular.

9. The process according to claim 8, wherein the cross section is a bean shape, thereby enabling formation of multiple channels between silicone-encapsulated super-hydrophilic filaments.

10. The process according to claim 1, further comprising treating the fabric produced in step iii) with additives selected from the group consisting of washing additives, bleaching additives, dying finishing additives, colorants, and finishing additives.

11. A cotton- or cellulose-containing fabric manufactured according to the process of claim 1.

12. The fabric of claim 11, wherein the fibers are cotton fibers.

13. The fabric of claim 11, wherein the fibers are processed-cellulose fibers.

14. The fabric of claim 11, further comprising a synthetic fiber combined with the hydrophobized yarn.

15. The fabric of claim 11, wherein the super-hydrophilic filaments encapsulated with nanoparticles of silicone formed by carrying out steps i) and ii) form open channels through which moisture is wicked from a wearer's skin to an outside of the fabric.

16. A textile article comprising the fabric of claim 11.

17. The textile article of claim 16, wherein the textile article is selected from the group consisting of apparel, garments, and clothing.

18. A process for manufacturing a cotton- or cellulose-containing fabric which exhibits improved moisture management compared to fabric not manufactured by the process, the moisture management further improving with repeated washing of the fabric, the process comprising consecutive steps of:

i) a hydrophilization step including immersing cotton or cellulose fibers in a composition including strong base and detergent, the composition added to the fibers to clear the fibers of oily and waxy materials and other impurities, thereby decreasing hydrophobicity of the fibers and converting the fibers to super-hydrophilic filaments;

ii) a hydrophobization step including immersing the super-hydrophilic filaments resulting from carrying out step i) in a suspension comprising silicone nanoparticles and bringing each individual super-hydrophilic filament of the super-hydrophilic filaments in contact with the silicone nanoparticles, thereby encapsulating the super-hydrophilic filaments in silicone and obtaining hydrophobized yarn; and iii) a production step including tightly weaving or knitting the hydrophobized yarn obtained in step ii) into the fabric exhibiting improved moisture management that further improves with repeated washing of the fabric.

19. A process for manufacturing hydrophobized yarn, the process comprising consecutive steps of:

immersing cotton or cellulose fibers in a composition including strong base and detergent, the composition added to the fibers to clear the fibers of oily and waxy materials and other impurities, thereby decreasing hydrophobicity of the fibers and converting the fibers to super-hydrophilic filaments; and immersing the super-hydrophilic filaments in a suspension comprising silicone nanoparticles and bringing each individual super-hydrophilic filament of the super-hydrophilic filaments in contact with the silicone nanoparticles, thereby encapsulating the super-hydrophilic filaments in silicone and obtaining hydrophobized yarn.

20. A fabric manufactured from the hydrophobized yarn of claim 19.

* * * * *